US005865656A

United States Patent [19]

Sims

[11] Patent Number: 5,865,656

[45] Date of Patent: Feb. 2, 1999

[54] MARKER BUOY WITH SELF DEPLOYING ANCHOR

[75] Inventor: John Timothy Sims, Bainbridge, Ga.

[73] Assignee: American Bandit, Inc., Bainbridge, Ga.

[21] Appl. No.: 853,071

[22] Filed: May 8, 1997

[51] Int. Cl.[6] ..... B63B 22/18

[52] U.S. Cl. ..... 441/6; 441/25; 441/26

[58] Field of Search ..... 441/6, 21, 22, 441/23, 24, 25, 26, 28

[56] References Cited

U.S. PATENT DOCUMENTS

| | | | |
|---|---|---|---|
| 1,993,974 | 3/1935 | McVicker | 9/8 |
| 3,020,567 | 2/1962 | Colt | 9/8 |
| 3,089,156 | 5/1963 | Hamm | 9/9 |
| 3,121,889 | 2/1964 | Gentile | 441/6 |
| 3,940,814 | 3/1976 | Bayles et al. | 441/25 |
| 4,731,036 | 3/1988 | Ulf | 441/2 |
| 4,781,636 | 11/1988 | Schurr | 441/11 |
| 4,927,395 | 5/1990 | Saulnier et al. | 441/26 |
| 5,188,551 | 2/1993 | Keller | 441/6 |
| 5,273,468 | 12/1993 | Nichols | 441/6 |

*Primary Examiner*—Sherman Basinger
*Attorney, Agent, or Firm*—Isaf, Vaughan & Kerr

[57] ABSTRACT

A small, lightweight, reusable marker buoy is provided for marking a selected location on a body of water. The marker buoy has a buoyant float formed with an upwardly open well within which is mounted a rotatable anchor line spool. A conduit directs anchor line from the spool, through the float body, and out the bottom of the float where it is attached to a weighted anchor. A spring biased friction plate within the well provides resistance to rotation of the spool and a nut that secures the spool on an upwardly projecting spindle can be tightened to press the spool against the friction plate with a predetermined force to provide a preselected resistance to rotation of the spool and thus a preselected tension on the anchor line. In use, the resistance is set to allow the weighted anchor to draw anchor line from the spool as the anchor sinks but to resist further deployment of anchor line from the spool due to wave and wind action after the anchor has fully deployed. A fin and current direction indicator line is provided to indicate visually the direction of current in a region where the buoy is deployed.

25 Claims, 2 Drawing Sheets

MARKER BUOY WITH SELF DEPLOYING ANCHOR

TECHNICAL FIELD

This invention relates generally to floating marker buoys for marking a preselected location on a body of water and more specifically to a self contained, light weight, reusable marker buoy for use by fishermen and divers.

BACKGROUND OF THE INVENTION

Fisherman, divers, treasure hunters, coast guards, and others have long had a need to mark a location of interest on a body of water so that the location can be maintained or found easily at a later date. The need might arise, for example, from a desire to mark the location of a promising fishing spot, the location of an underwater artifact, or the location of submerged geographic features of interest to pleasure divers. In either event, it is desirable that the location be marked with a floating visible buoy that is anchored securely in place, is not subject to drift as a result of wind and wave action and that is lightweight, reliable, and reusable.

A variety of attempts have been made to provide lightweight reusable marker buoys. Some examples are disclosed in U.S. Pat. No. 1,993,974 of McVicker, U.S. Pat. No. 3,020,567 of Colt, U.S. Pat. No. 3,089,156 of Hamm, U.S. Pat. No. 4,731,036 of Ulf, U.S. Pat. No. 4,781,636 of Schurr, U.S. Pat. No. 4,927,395 of Saulnier et al., U.S. Pat. No. 5,188,551 of Keller, and U.S. Pat. No. 5,273,468 of Nichols. While many of the devices of these patents represent nobel attempts to provide convenient, lightweight, reusable marker buoys, they nevertheless embody various problems and shortcomings inherent in their designs. The McVicker device, for example, has an anchor line wrapped about the body of the buoy and the buoy floats horizontally as the anchor sinks and the anchor line unwinds freely. All the while, the lower portion of the buoy slowly fills with water and, at some point, the buoy rights itself into a floating vertical orientation wherein the anchor line is caught by a hook to prevent further deployment of the line. One problem with this design is that it is unpredictable. When the buoy rights itself from the ballast it has taken on, anchor deployment stops. If the anchor has not yet reached the bottom when the buoy is righted, the entire assembly simply floats away. On the other hand, if the anchor reaches the bottom long before the buoy rights itself, then the anchor line will continue to deploy, particularly in the present of a strong current or strong wind. In such a case, the buoy can float far from the actual location of the anchor and the location that was intended to be marked. Finally, the free deployment of the anchor line can lead to entanglement that can render the entire system inoperative.

The Colt device seeks to provide a measured resistance to deployment of anchor line but is mechanically complex and necessarily includes metal components that are subject to rust and that require maintenance. Hamm discloses a windless that deploys and anchor and locks the anchor line when the anchor is deployed. This device is also subject to tangles because of the free wheeling deployment of the anchor line and can be subject to drift in rough seas as the bobbing float lifts the anchor off of the bottom. Nichols is also subject to the problems of free wheeling anchor line deployment and the problems associated with a locked anchor line after deployment of the anchor. Further, the locking notch in Nichols is positioned so that it can accidently catch the anchor line as it is paid out, thus preventing the anchor from reaching the bottom. Devices disclosed in the other patents, such as the Schurr and Saulnier patents, are mechanically complex, subject to malfunction, and also embody many of the shortcomings already discussed.

Accordingly, a continuing need exists for an improved marine marker buoy that is lightweight, economical, reusable, and that reliably marks a preselected location on a body of water without entanglement of the anchor line during deployment and without surf and wind induced drift after the anchor is deployed. Such a buoy should deploy its anchor to the proper depth automatically when tossed into the water and should be able to accommodate anchors of various sizes and weights as needed depending upon the condition of the surf. The buoy should be resistant to corrosion and should allow for easy retraction of the anchor when the buoy is to be retrieved and moved to another spot to be marked. Finally, such a buoy should indicate clearly to its user the direction of the water current in the region in which the buoy is deployed and should be configured so that the functional components of the buoy are kept out of the water and substantially dry during use. It is to the provision of such a marine marker buoy that the present invention is primarily directed.

SUMMARY OF THE INVENTION

Briefly described, the present invention, in a preferred embodiment thereof, comprises a marker buoy for marking a preselected location on a body of water. The marker buoy includes a frustro-conically shaped buoyant float having a top and a bottom and sides that diverge from the top to the bottom. The float preferably is formed from a corrosion resistant expanded foam material such as polystyrene and defines a cylindrically shaped upwardly open well having walls and a floor. A spindle projects upwardly from the floor of the well in the center thereof and is provided with a threaded free upper end. An anchor line spool has a core about which anchor line is wound, a top plate, a bottom plate, and a central passageway extending along the rotational axis of the spool. The spool is mounted within the upwardly open well of the float with the spindle extending through the central passageway of the spool, the bottom plate of the spool located adjacent the floor of the well, and the top plate of the spool exposed at the top of the float. A nut is threaded onto the upper end of the spindle to hold the spool in place within the well and a tube embedded within the float body directs anchor line from the spool within the well to and through the bottom of the float, where the line is attached to a weighted anchor. When the buoy is tossed in the water, the anchor sinks to the bottom drawing anchor line from the spool as it goes.

A disc-shaped friction plate is mounted in the well between the bottom plate of the spool and the floor of the well. A pair of compression springs are positioned in receptacles in the floor of the well and extend upwardly therefrom to engage the bottom of the friction plate. In this way, the compression springs urge or bias the friction plate into engagement with the bottom plate of the spool. The nut that holds the spool on the spindle can be tightened against the top of the spool if desired to urge the spool down against the friction plate and against the bias of the compression springs with progressively greater force. This action functions to increase the friction between the friction plate and the spool. Conversely, the nut can be loosened if desired to reduce the friction imparted to the spool by the friction plate. In this way, the force and friction between the friction plate and the bottom plate of the spool can be adjusted by appropriate manipulation of the nut to provide a preselected amount of resistance to rotation of the spool within its well. This, in turn, adjusts the amount of tension imparted to the anchor line as the line is paid out from the spool during deployment of the anchor.

A thin fin is embedded within and projects downwardly from the bottom of the float on one side thereof. A corresponding visible indicator line is emblazoned on the outside of the float on the opposite side from the fin. With this configuration, the float, when deployed on a body of water, is turned into the current by the downwardly projecting fin. This faces the visible indicator line into the current. Accordingly, immediately upon deployment, the buoy of this invention provides not only a spot marker, but also provides a visual indication of the direction of the current in the region in which the buoy is deployed. A diver's flag, light stick or other indicator can be inserted into the top of the buoy or mounted on the upper tip of the spindle if desired as further indicia of the location and nature of the buoy.

To use the buoy of this invention, the retaining nut on top of the spindle is rotated against the spool to provide a desired amount of resistance to rotation of the spool and thus a desired amount of tension on the anchor line as the line is paid out. The tension should be selected to be small enough to allow the anchor to draw anchor line from the spool as it sinks to the bottom without entangling the line yet large enough to prevent anchor line from being pulled from the spool under the influence of wind, current, and waves so that the buoy does not drift once deployed.

With the tension properly selected and set, the buoy is tossed into the water. The weighted anchor immediately begins to sink to the bottom drawing the tensioned anchor line from the spool as it goes. When the anchor reaches the bottom, the buoy is anchored in place and immediately turns into the current to indicate current direction. It has been found that supplemental tension is imparted to the anchor line by the convolutely shaped tube that directs the line through the body and out the bottom of the float. This supplemental tension helps prevent free wheeling of the spool during deployment and, after deployment, resists further pay out of line from the spool as a result of the jerky bobbing motion that can be imparted to the float by wave action. This, in turn, prevents the float from drifting off of its intended spot.

When it is desired to retrieve the buoy of this invention, a user simply lifts the float out of the water and winds the spool like a fishing reel to draw the anchor line and the anchor up. The buoy can then be reused indefinitely by following the same procedures an another location to be marked.

Thus, an improved self anchoring marker buoy is now provided that addresses and solves the problems of the prior art. More specifically, the buoy of this invention is economical to produce, simple to operate, and deploys its anchor time and time again without tangles, premature latching, or wave and wind induced drifting. In addition, the buoy of this invention automatically orients itself into the current and includes a indicator line that clearly informs a user of the direction of the current in the region where the buoy is deployed. These and other features, objects, and advantages of the invention will become more apparent upon review of the detailed description set forth below when taken in conjunction with the accompanying drawings, which are briefly described as follows.

DETAILED DESCRIPTION OF THE PREFERRED EMBODIMENT

Figure 1:
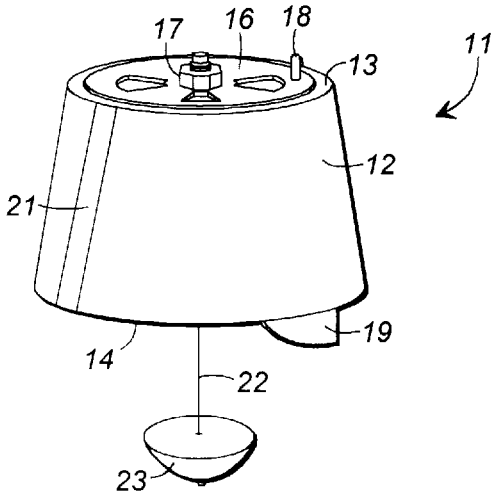
FIG. 1 is a perspective view of a marker buoy that embodies principles of the present invention in a preferred form.
Figure 2:
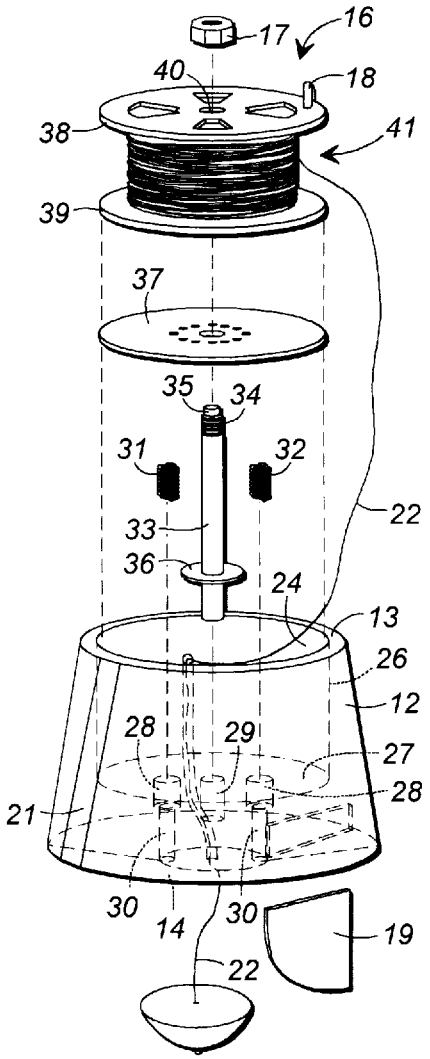
FIG. 2 is a perspective exploded view of the buoy of FIG. 1 showing the relationships of the various functional components of the buoy.

Referring now in more detail to the drawings, in which like numerals refer to like parts throughout the several views, FIGS. 1 and 2 show in perspective and perspective exploded views respectively a marker buoy that embodies principles of this invention in a preferred form. The marker buoy 11 comprises a buoyant float having a float body 12, a top 13, and a bottom 14. In the preferred embodiment, the float is generally frustro-conical in shape with the top of the float being somewhat smaller in diameter than the bottom and with the sides diverging from the top to the bottom. The float body itself preferably is formed of an expanded foam material that is light, very buoyant, and resistant to corrosion by the elements or by oil and fuel residues often found in and around boats. It has been found that an expanded polyethylene or and expanded polystyrene foam or, preferably, a tough expanded foam material marketed under the trade name ARCEL, functions exceptionally well and represents the best mode known to the inventor of carrying out the invention. However, other buoyant materials and even a hollow molded shell may be employed within the scope of the invention.

The top of the float is formed with a generally cylindrical upwardly open well 24 defined by sides 26 and a floor 27 (FIG. 2). The floor 27 is provided with a pair of radially arrayed compression spring receptacles 28 and a centrally located spindle receptacle 29. Respective drainage ports 30 communicate between the compression spring receptacles 28 and the bottom 14 of the float to drain away any water that may collect in the well 24 during use of the buoy.

A spindle 33 has its bottom end secured within the spindle receptacle 29 with the spindle 33 projecting upwardly from the well floor along the axis of the well. The top of the spindle 33 is provided with threads 34 and a tip 35 that is smaller in diameter than spindle itself. A washer 36 surrounds the spindle 33 and, in practice, is securely fixed with adhesive or the like to the floor of the well surrounding the spindle shaft. This helps to secure the spindle in place and provides some additional strength to the spindle during use of the buoy. The spindle 33 as well as the washer 36 preferably are made of a plastic material that will not rust and that resists corrosion by chemicals and fossil fuel products.

Figure 4:
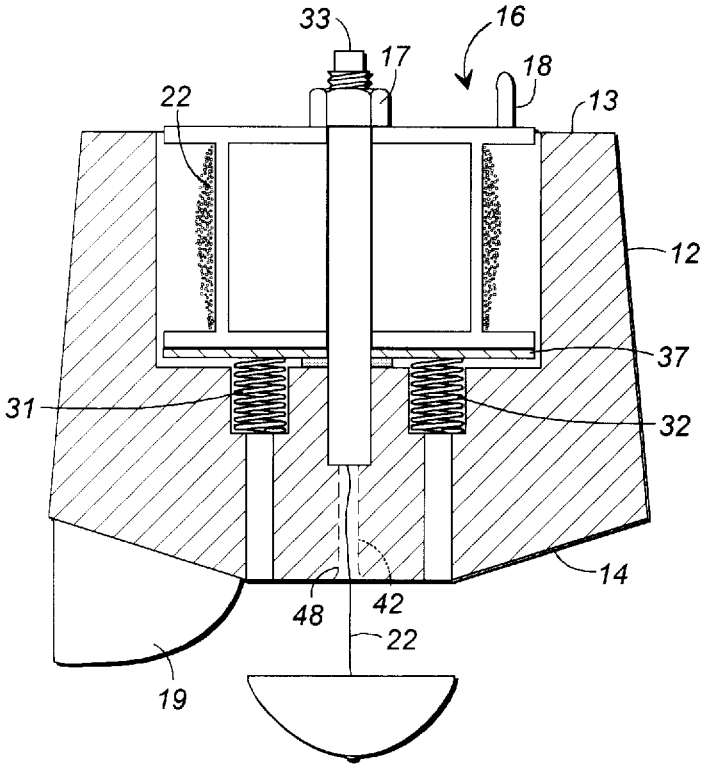
FIG. 4 is a partially sectioned view of the marker buoy of this invention showing internal working components thereof.

A pair of stainless steel compression springs 31 and 32 are each nestled within a respective one of the compression spring receptacles 28 as best illustrated in FIGS. 2 and 4. The compression springs are sized so that their top portions project a predetermined distance upwardly from the floor of the float when the bottoms of the springs rest on the bottoms of their receptacles. The springs are slightly smaller in diameter than their receptacles so that they may expand and contract freely within the receptacles. The stainless steel construction of the springs is greatly preferred to other metals because stainless steel resists rusting and other deterioration, even when used around salt water.

A generally disc-shaped friction plate 37 is formed with a central opening sized to be received on the spindle 33. The friction plate 37 preferably is made of an abrasion resistant plastic material and is provided with a set of circularly arranged ports arrayed about the central opening. The array of ports provides drainage for water that may tend to collect on top of the friction plate so that the water can pass to the floor of the well where it is drained out of the buoy through the compression spring receptacles.

As best illustrated in FIG. 4, when the friction plate 37 is slid down over the spindle 33 to the bottom area of the well 24, the bottom of the friction plate rests on and is supported by the tops of the compression springs 31 and 32. With this configuration, downward force exerted on the friction plate 37 acts against the bias of the compression springs. In response to such force, the springs progressively compress within their receptacles to provide a progressively increasing upward force on the friction plate that counteracts the downward force exerted on the plate. This relationship holds until the downward force on the friction plate is sufficient to bottom out the friction plate against the washer 36.

A spool 16 is sized to be positioned within the upwardly open well of the float. The spool 16 has a core 41 about which a supply of anchor line 22 is securely wound, a generally disc-shaped top plate 38, and a similar disc-shaped bottom plate 39. The top and bottom plates 38 and 39 function to capture the anchor line and confine it to the core of the spool in a manner similar to the reel of a fly fishing rig. Preferably, the spool 16 is molded of corrosion resistant plastic material and may be formed with a central spoke arrangement to conserve the plastic material from which the spool is molded. The spool 16 is formed with a central passageway 40 that extends along the rotational axis of the spool and that is sized to be received over the spindle 33 within the well 24. A handle 18 projects upwardly from the top plate 38 of the spool for manual rotation thereof to retrieve an anchor line as discussed in more detail below.

In use, the spool 16 is installed in the upwardly open well 24 with its bottom plate resting against the friction plate 37 and with its top plate exposed at the top 13 of the float as best illustrated in FIG. 1. With this configuration, the core of the spool and thus the anchor line is completely enclosed within the float where it is protected from corrosive ingredients and items that might otherwise snag or tangle the line. A nut 17 is adapted to be threaded onto the threaded end 35 of the spindle 33 to hold the spool securely in place within the well 24 and to adjust the force with which the spool is pressed against the friction plate 37. The nut 17 preferably is formed from teflon or other resilient plastic material and is sized to be threaded easily by hand. When tightened against the spool 16, the nut 17 forces the spool 16 downwardly into the well with progressively increasing force against the friction plate 37 in the bottom of the well. The compression springs react by imparting a correspondingly increasing upward force on the friction plate. In this way, the force between the bottom plate of the spool and the friction plate and thus the friction imparted to the spool by the friction plate can be increased by tightening the nut 17 against the spool. Conversely, the friction imparted to the spool can be decreased by loosening the nut. With this arrangement, the resistance to rotation of the spool within the well can be adjusted by appropriate adjustment of the nut 17. This, in turn, allows adjustment of the amount of tension that is imparted to the anchor line as the anchor sinks to the bottom of a body of water to permit tangle free operation and to avoid wave or wind induce drift that can occur with some prior art marker buoy arrangements.

A thin crescent fin 19 (FIG. 2) is embedded within and projects downwardly from the bottom 14 of the float. The fin is formed of a corrosion resistant plastic and is oriented so that the crescent portion of the fin curves upwardly toward the center of the float. A vertical indicator line 21 is emblazoned on the float body 12 at a location diametrically opposed to the location of the fin 19. As described in more detail below, the fin and indicator line function in conjunction with one another to provide a user with an instant visual indication of the direction of the current in a region of a body of water in which the buoy of this invention is deployed.

Figure 3:
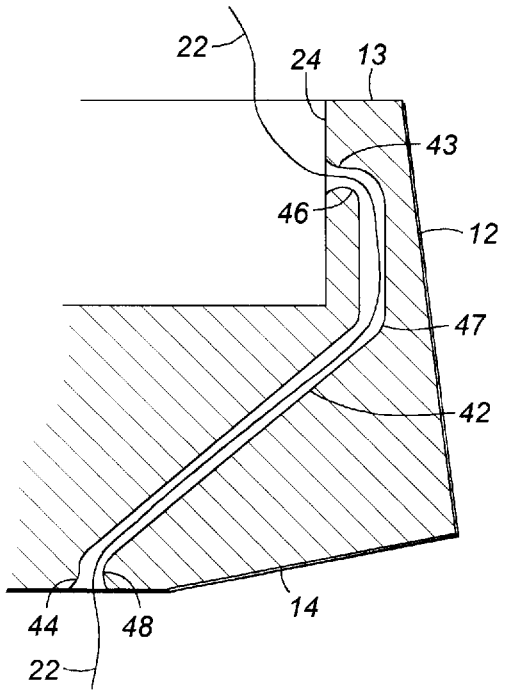
FIG. 3 is a partial sectional view of the float portion of the buoy illustrating a preferred configuration and placement of the anchor line conduit within the float body.

As best illustrated in FIG. 3, a convolutely shaped guide tube 42 is embedded within the material of the float body 12 and functions to direct anchor line from the spool with the well 24 to and through the bottom of the float at the center thereof. The guide tube 42 has a flared upper end 43, which communicates with the well 24, and a flared lower end 44, which communicates through the bottom of the float at the center thereof. The guide tube 42 follows a convolute path through the float and, to accommodate this path, is formed with a first bend 46, a second bend 47, and a third bend 48. These bends direct the anchor line 22 directly from the spool 16, thence downwardly adjacent the side wall 26 of the well, and thence angularly under the well to the center of the float bottom 14, where the anchor line exits the float to a free end that can be attached to a weighted anchor 23 (FIG. 1).

Preferably, the guide tube 42 is formed of copper so as to resist corrosion. In addition, the convolute shape of the tube has been found to impart a supplemental friction to the anchor line as the line is paid out during deployment of the anchor. This supplemental friction works in conjunction with the friction and rotational resistance provided by the friction plate to insure against line tangles within the well. In addition, it has been discovered that the resistance imparted to the line by the guide tube increases dramatically when the line is sharply tugged or jerked and functions essentially as a break under such conditions. This aspect of the tube has proven to guard against additional pay out of line from the spool after deployment of the anchor due to the jerky action of the waves on the float. Thus, once the buoy of this invention is deployed, it does not tend to drift under the influence of wind or waves as many prior art buoy systems can do.

The buoy of this invention is simple and reliable to operate. When a user wishes to mark a location on a body of water, he simply adjusts the nut 17 to provide the proper tension for the size anchor being used. While this is in some ways a matter of experience, the tension should be adjusted so that the anchor draws anchor line from the spool relatively freely as the anchor falls under the influence of gravity yet not so freely that the anchor line becomes slack and subject to tangles. An additional consideration is that the tension should be sufficient to resist further pay out of the line due to wind and wave action after the anchor has deployed.

Once the tension is properly set, the buoy is tossed overboard. The anchor immediately begins to sink to the bottom drawing tensioned anchor line from the spool as it goes. When the anchor reaches the bottom, the buoy is positioned on the surface directly over the spot that has been marked. Correct adjustment of tension insures that the buoy does not drift after the anchor has deployed. As soon as the anchor reaches the bottom, any moving currents act on the depending fin 19 to orient the float directly into the current. The indicator stripe 21 is thus oriented in the direction from which the current flows as a clear indicator to the user of the direction of current in the region where the buoy is deployed.

When it is desired to retrieve the buoy, a user simply lifts the float out of the water and rotates the spool manually with the upwardly projecting handle 18. This draws the anchor line back in and draws the anchor up from the bottom until it is nestled against the bottom of the float. The buoy is then ready for a subsequent use and can be used over and over again to mark desired locations.

The invention has been described herein in terms of a preferred embodiment. While this embodiment represents the best mode known to the inventor at the time of filing for carrying out his invention, those of skill in the art might well modify the preferred embodiment within the scope of the invention. For example, the materials from which the various components are formed could be changed as could the shape of the float and other physical aspects. These and other additions, deletions, and modifications might well be made to the illustrated embodiment without departing from the spirit and scope of the invention as set forth in the claims.

I claim:

1. A marker buoy for marking a selected location on a body of water, said marker buoy comprising:

a buoyant float having a float body with exterior sides, a top, and a bottom;

said top of said float body being formed with an upwardly open well extending a predetermined distance into said float body and being defined by sides and a floor;

A spool for storing, paying out, and retrieving anchor line, said spool having a spool core about which anchor line can be wound, a top plate, a bottom plate, a handle projecting from said top plate, and a central passageway extending along a rotational axis of said spool;

means for mounting said spool in said upwardly open well for rotation of said spool about its rotational axis and with said top plate of said spool being exposed at said top of said float body, said means comprising a spindle extending upwardly from said floor of said well and means for reinforcing said floor at the position of said spindle;

means in said float body for directing anchor line from said spool within said well through said bottom of said float body for attachment to a weighted anchor; and means for applying a selectable resistance to rotation of said spool within said well to provide a preselected tension on the anchor line as it is paid out during deployment of the anchor.

2. A marker buoy as claimed in claim 1 and wherein said buoyant float is formed of an expanded foam material.

3. A marker buoy as claimed in claim 2 and wherein said expanded foam material comprises an expanded polyethylene foam.

4. A marker buoy as claimed in claim 2 and wherein said expanded foam material comprises an expanded polystyrene foam.

5. A marker buoy as claimed in claim 2 and wherein said expanded foam material comprises ARCEL.

6. A marker buoy as claimed in claim 1 and wherein said buoyant float is substantially frustro-conically shaped with said top of said float body being smaller in diameter than said bottom of said float body.

7. A marker buoy as claimed in claim 6 and wherein said upwardly open well is substantially cylindrically shaped.

8. A marker buoy as claimed in claim 1 and wherein said spindle is sized and located to be received in said central passageway of said spool for rotation of said spool about spindle.

9. A marker buoy as claimed in claim 1 and where in means for directing anchor line comprises means forming a conduit communicating between said sides of said well and said bottom of said float body.

10. A marker buoy as claimed in claim 9 and wherein said means forming a conduit comprising a tube embedded within said float body, said tube having an inlet end communicating with said upwardly open well through said sides thereof and an outlet end communicating through said bottom of said float body.

11. A marker buoy as claimed in claim 10 and wherein said tube is formed with at least one bend for configuring said tube to fit within said float body and for imparting friction to an anchor line as the anchor line is paid out through said tube.

12. A marker buoy as claimed in claim 1 and wherein said means for applying a selectable resistance to rotation of said spool comprises a friction plate positioned between said floor of said well and said spool and means for urging said friction plate into engagement with said spool for imparting friction to said spool to resist rotation thereof as anchor line is paid out from said spool.

13. A marker buoy as claimed is claim 12 and wherein said means for urging said friction plate into engagement with said spool comprises at least one compression spring configured and positioned for yieldably biasing said friction plate away from said floor of said well and into engagement with said spool.

14. A marker buoy as claimed in claim 13 and wherein said spindle has a threaded upper end and projects upwardly from said floor of said well and through said central passageway of said spool for rotation of said spool about said spindle, and further comprising a nut threaded onto said threaded upper end of said spindle for selectively tightening against said spool to urge said spool against said friction plate with a preselected force to provide a selectable resistance to rotation of said spool.

15. A marker buoy for marking a selected location on a body of water, said marker buoy comprising a buoyant float having a bottom and an upwardly open well with a floor, a spindle projecting upwardly from said floor of said well, means for reinforcing said floor of said well adjacent said spindle, an anchor line spool rotatably mounted about said spindle in said upwardly open well for storing, paying out, and retrieving anchor line, a conduit formed in said float for directing anchor line from said spool to the exterior of said float for deployment of an anchor from said float, and means for imparting resistance to rotation of said spool to control the paying out of anchor line from said float during deployment of an anchor therefrom, said means for imparting resistance to rotation of said spool comprising a friction plate located in said well and means for biasing said friction plate into engagement with said spool to impart friction thereto.

16. A marker buoy as claimed in claim 15 and wherein said means for biasing said friction plate comprises at least one compression spring in said well, said compression spring being configured and positioned for yieldably biasing said friction plate into engagement with said spool.

17. A marker buoy as claimed in claim 16 and wherein said well is substantially cylindrical and is defined by sides and a floor, said friction plate being substantially disc-shaped and being located between said floor of said well and said spool, said compression spring being at least partially positioned between said friction plate and said floor of said well.

18. A marker buoy as claimed in claim 15 and further comprising means for indicating the direction of current flow in a region where said buoy is deployed.

19. A marker buoy as claimed in claim 18 and wherein said means for indicating the direction of current comprises a fin depending from said float for orienting said float relative to the current and visible indicia on said float for visually indicating the orientation of said float and thus the direction of the current.

20. A marker buoy for marking a selected location of a body of water, said marker buoy comprising a buoyant float having a top and a bottom, an upwardly open well formed in said top with said well being defined by walls and a floor, a spindle projecting upwardly from said floor of said well, means for reinforcing said floor about the location of said spindle, an anchor line spool rotatably mounted in said upwardly open well for storing, paying out, and retrieving anchor line from said float, said spool having an exposed handle for selective manual rotation of said spool within said well, a supply of anchor line on said spool, a conduit for directing said anchor line from said spool within said well out said bottom of said float to a free end of said anchor line, and a weighted anchor secured to said free end of said anchor line, whereby when the buoy is tossed in the water, the anchor sinks to the bottom drawing the anchor line from the spool within the upwardly open well to anchor the buoy at its selected location.

21. A marker buoy as claimed in claim 20 and further comprising means for imparting a selected resistance to rotation of said spool within said well to permit deployment of said anchor line as said anchor sinks but to prevent deployment of additional anchor line due to wave action subsequent to deployment of said anchor.

22. A marker buoy as claimed in claim 21 and wherein said means for imparting resistance comprises a friction plate mounted in said well and means for yieldably biasing said friction plate into engagement with said spool to impart friction thereto and thus resistance to rotation thereof.

23. A marker buoy as claimed in claim 22 and wherein said means for yieldably biasing comprises at least one compression spring.

24. A marker buoy as claimed in claim 23 and wherein said friction plate is substantially disc-shaped and is positioned between said spool and said floor of said upwardly open well.

25. A marker buoy as claimed in claim 20 and further comprising means for indicating the direction of current in a region of a body of water in which said buoy is deployed, said means comprising a fin depending from said float to orient said float relative to the current and visible indicia on said float for indicating the orientation of said float and thus the direction of the current.

* * * * *